US005798173A

United States Patent [19]

Momma et al.

[11] Patent Number: 5,798,173

[45] Date of Patent: Aug. 25, 1998

[54] INK JET RECORDING SHEET

[75] Inventors: Kenji Momma; Kouji Idei, both of Tokyo, Japan

[73] Assignee: Mitsubishi Paper Mills Limited, Tokyo, Japan

[21] Appl. No.: 788,353

[22] Filed: Jan. 27, 1997

Related U.S. Application Data

[63] Continuation of Ser. No. 382,194, Feb. 1, 1995, abandoned.

[30] Foreign Application Priority Data

Mar. 4, 1994 [JP] Japan ..... 6-035024
Mar. 31, 1994 [JP] Japan ..... 6-063794

[51] Int. Cl.[6] ..... B41M 5/00

[52] U.S. Cl. ..... 428/342; 428/195; 428/211; 428/500; 428/522

[58] Field of Search ..... 428/342, 195, 428/500, 522, 537.5, 341, 211

[56] References Cited

U.S. PATENT DOCUMENTS 5,281,307 1/1994 Smigo et al. ..... 162/164.3
5,320,712 6/1994 Sawayama et al. ..... 162/168.2

FOREIGN PATENT DOCUMENTS 0 655 346 A1 5/1995 European Pat. Off. .
56-84992 7/1981 Japan .
64-8085 1/1989 Japan .
4-11094 1/1992 Japan .
A 0 490 231 A2 6/1992 Japan .
A 4 246 428 1/1993 Japan .

*Primary Examiner*—Pamela R. Schwartz
*Attorney, Agent, or Firm*—Armstrong, Westerman, Hattori, McLeland & Naughton

[57] ABSTRACT

Disclosed is an ink jet recording sheet which contains in a support and/or in a layer coated on the support a polyvinylamine copolymer obtained from a copolymer of N-vinylformamide and acrylonitrile and having a molecular weight of 50000 or more and containing 20 mol % or more of a vinylamine residue or an ink jet recording sheet comprising a support and an ink-receiving layer provided on the support wherein the composition of the ink-receiving layer contains said polyvinylamine copolymer and ultrafine inorganic pigment having a primary particle size of 100 nm or smaller.

5 Claims, No Drawings

INK JET RECORDING SHEET

This application is a continuation of application Ser. No. 08/382,194 filed Feb. 1, 1995, now abandoned.

The present invention relates to an ink jet recording sheet used for recording with a water-soluble ink and more particularly to an ink jet recording sheet which can provide recorded images excellent in density and sharpness in full color recording, is inhibited from spread of ink dots under high humidity circumstance and due to deposition of water-drops and is further inhibited from fading in color of the recorded images that is apt to occur with lapse of time, and thus is excellent in light resistance.

The ink jet recording method performs recording of letters or images by allowing ink droplets ejected by various working principles to deposit on a recording sheet such as paper. The ink jet recording has such favorable features that it makes high-speed recording possible, that it produces little noise, that it can easily perform multi-color recording, that there is no limitation as to kind of patterns, and that it requires no developing-fixing. Thus, the ink jet recording is rapidly becoming widespread as devices for recording various characters including kanji and color images. Furthermore, the images formed by the multi-color ink jet recording method are by no means inferior to those printed by a multi-color press of those obtained by a color-photography. Besides, use of the ink jet recording extends to a field of full-color image recording where number of copies is not so many, since costs per copy are less than those employing the photographic process. Furthermore, as a result of restudying of ink compositions, an ink jet recording method using pigment inks has also been developed and put to practical use, but most of the ink jet recording methods use water-soluble dyes.

As for the recording sheets used for ink jet recording methods, efforts have been made from the aspects of printer hardwares or ink composition in order to use fine papers or coated papers used for ordinary printing or writing. However, improvements in recording sheets have come to be required increasingly in order to go side by side with developments in printer hardwares such as ever increasing speed, development of ever finer definition and images of full color. That is, recording sheets are required to have the high image reproducibility, namely, it is required that image density of the printed ink dots be high and hue characteristics be bright and appealing, and the ink absorbing speed be high and as a result, the ink applied do not bleed or spread even though the recorded dots are put over additionally. Moreover, the diffusion of the recorded dot in the transverse direction should not be greater than needed and the circumference of dots should be sharp and demarcating. Moreover, the recording sheets are required to have the high storage stability, namely, it is required that storage stability of image quality under high humidity circumstance is high, water resistance of the image is high in case of waterdrops depositing on the prints for some reasons and no fading in color of dye occurs when the sheets are stored for a long period of time.

Some proposals have, hitherto, been made for meeting these demands on image quality. For example, it is attempted to improve ink absorbing property by providing an ink-receiving layer mainly composed of silica pigment on a support thereby letting it serve an absorbing layer. In order to obtain a high image density of printed dots and obtain printed dots free from spreading of ink dot, it is proposed to add non-colloidal silica powders to the above proposed ink-receiving layer. A further attempt looks at the dye distribution state in the ink-receiving layer as a factor influencing tinctorial characteristics and sharpness, and proposes to use a specific agent which adsorbs the dye component in the ink.

Some proposals have been made for improving water resistance of dyes. For example, Japanese Patent Kokai (Laid-Open) No.56-84992 proposes to coat a polycationic polyelectrolyte on the surface of a recording medium. Furthermore, in order to improve both the water resistance and the light resistance of dyes, an ink jet recording sheet which contains a basic oligomer has been proposed. As an example of using polyvinylamine copolymers, Japanese Patent Kokai (Laid-Open) No.64-8085 proposes an ink jet recording material improved in water resistance and light resistance by using vinylamines containing no (meth)acrylic acid monomer unit.

As mentioned above, there are various proposals to improve qualities of images recorded by ink jet recording method using water-soluble inks, but improvement in water resistance and light resistance is still insufficient and the printed sheet must be handled or stored with care. The recording sheet can be either a neutral paper or an acidic paper, but recently, neutral papers made by subjecting acidic papers to a size press treatment are increasingly used thanks to their higher storage stability and furthermore, since inexpensive calcium carbonate can be used as a loading material.

The object of the present invention is to provide an ink jet recording sheet which satisfies the following requirements.

1. It has water resistance high enough to inhibit spread of ink dot even in a high humidity circumstance and even when waterdrops deposit on the image.

2. It can provide good light resistance of dyes and has physical storage stability of supports.

3. It has no limitation on pH value of recording materials and supports.

4. It can produce images of good quality such as good color formation and high resolution.

The inventors have conducted intensive research and as a result, have invented an ink jet recording sheet which provides the dye of ink with water resistance and light resistance and is excellent in fixability of ink.

That is, the present invention provides an ink jet recording sheet containing in the support and/or the surface thereof a polyvinylamine copolymer which has a weight-average molecular weight of 50000 or more and contains 20 mol % or more of a vinylamine residue and which is obtained from a copolymer of N-vinylformamide and acrylonitrile.

In the ink jet recording sheet of the present invention, it is preferred that the polyvinylamine copolymer is contained in the support in an amount of 1% by weight or more based on the solid content of pulp in the support or is coated on the support in an amount of 0.1 $g/m^2$ or more.

It is further preferred that the extraction pH of the support is 6–9.

The present invention further provides an ink jet recording sheet comprising a support and an ink-receiving layer provided on the support wherein a composition of the ink-receiving layer contains ultrafine inorganic pigment having a primary particle size of 100 nm or smaller and a polyvinylamine copolymer which has a weight-average molecular weight of 50000 or more and contains 20 mol % or more of a vinylamine residue and which is obtained from a copolymer of N-vinylformamide and acrylonitrile as a dye fixer.

In the ink jet recording sheet of the present invention, coating amount of the ink-receiving layer is preferably 0.5 g/m$^2$ or more and content of the polyvinylamine copolymer in the composition of the ink-receiving layer is preferably 20% by weight or more.

In the ink jet recording sheet of the present invention, the extraction pH of the support is preferably 6–9. The extraction pH is measured according to JIS P-8133.

The ink jet recording sheet of the present invention will be explained in detail.

As is well known, in order to improve water resistance of the water-soluble ink containing direct dyes or acid dyes which is used for ink jet recording, it is effective to fix the dye by the reaction of anionic part of the dye with a cationic substance and to impart water resistance to the dye. From the viewpoint of light resistance, namely, storage stability, tertiary or quaternary cationic substances which are strong in cationic properties tend to accelerate color fading, and the light resistance and the water resistance are contrary to each other and moreover, when a neutral paper of about 6–9 in pH value is prepared, no sufficient cationic properties can be obtained unless tertiary or quaternary cationic polymers are used. Thus, sufficient water resistance cannot be obtained. Furthermore, the above-mentioned method for improving water resistance and light resistance using vinylamines containing no (meth)acrylic acid monomer unit cannot give a sufficient water resistance.

It is said that primary amines show substantially no cationic properties in an atmosphere called neutral, but polyvinylamine copolymers do not lose cationic properties even under a pH of 7 or higher because of its polymer structure. Therefore, it has been found that not only an acidic paper having an extraction pH of lower than 6 prepared in an acidic atmosphere, but also a support having an extraction pH of 6–9 prepared in a neutral or weakly alkaline atmosphere can give water resistance to water-soluble dyes and do not cause decrease in light resistance.

Even the polyvinylamine copolymer obtained by copolymerization of N-vinylformamide and acrylonitrile used in the present invention cannot provide sufficient water resistance if the content of vinylamine residue is less than 20 mol %. Furthermore, if the molecular weight of the copolymer is small, fixability of the polyvinylamine copolymer to pulp and the coated layer is inferior and the copolymer bleeds together with the dye and this is not preferred for water resistance.

It has been found that when a polyvinylamine copolymer which has a weight-average molecular weight of 50000 or more and contains 20 mol % or more of a vinylamine residue and which is obtained by copolymerization of N-vinylformamide and acrylonitrile is contained in the support and/or the surface thereof as a fixer for water-soluble ink, water resistance can be imparted to ink jet recording sheets having a support of not only an acidic paper, but also a neutral paper prepared by incorporation of a basic loading material or by size press treatment with alkalis.

The polyvinylamine copolymers used in the present invention are those which are described, for example, in Japanese Patent Kokai (Laid-Open) Nos.58-23809 and 1-040694.

Monomers used for synthesis of the polyvinylamine copolymers include, for example, N-vinylacetamide, N-vinylpropionamide, methyl N-vinylcarbamate, ethyl N-vinylcarbamate and isopropyl N-vinylcarbamate in addition to N-vinylformamide. Monomers copolymerized with N-vinylformamide include, for example, acrylonitrile, (meth)acrylates composed of alcohols of 1–4 carbon atoms and (meth)acrylic acid, acrylamide and (meth)acrylic acid. Especially preferred are acrylonitrile and acrylamide.

Especially, it has been found that water resistance is markedly improved by using as a dye fixer a polyvinylamine copolymer which has a weight-average molecular weight of 50000 or more and contains 20 mol % or more of a vinylamine residue among copolymers of N-vinylformamide and acrylonitrile and the water resistance is further improved by using an ultrafine inorganic pigment in combination with the copolymer. Thus, the present invention has been accomplished.

Furthermore, image quality and color formability can be improved by using ultrafine inorganic pigments having a primary particle size of 100 nm or less and capable of adsorbing dyes in combination with the polymers, and for further improvement of image density and resolution, use of surface sizing agents described in Japanese Patent Application No.5-266717 filed by the present inventors is effective.

As the ultrafine inorganic pigments having a primary particle size of 100 nm or less used in the present invention, mention may be made of, for example, silica (colloidal silica, etc.), alumina or alumina hydrates (alumina sol, colloidal alumina, cationic aluminum oxides or hydrates thereof, pseudoboehmite, etc.), surface-treated cationic colloidal silica, aluminum silicate, magnesium silicate and magnesium carbonate. More preferred are those of porous primary particles, but even though they are non-porous, preferably they agglomerate at the time of preparation of coating liquid or further agglomerate at the time of coating and drying, resulting in a porous surface coat on the surface of the pulp fibers.

The ink jet recording sheets of the present invention are those which are used for printers of drop on demand type and continuous type, facsimiles and copiers which use water-soluble inks.

In the composition for ink-receiving layer, there may be used general water-soluble polymeric binders. Examples of the binder are synthetic resin binders such as polyvinyl alcohol, vinyl acetate, silyl-modified polyvinyl alcohol, polyvinyl butyral, polymethyl methacrylate, polyurethane resin, unsaturated polyester resin, vinyl chloride-vinyl acetate copolymer, alkyd resin, styrene-butadiene copolymer latex, methyl methacrylate-butadiene copolymer latex, polymer or copolymer latexes of acrylic acid and methacrylic acid and ethylene-vinyl acetate copolymer latex, aqueous binders, for example, thermosetting resins such as melamine resin and urea resin, oxidized starch, etherified starch, cellulose derivatives such as carboxymethyl cellulose and hydroxyethyl cellulose, gelatin, soybean protein and casein. These may be used each alone or in combination of two or more. Furthermore, known cationic resins may also be used together for fixing the dyes.

As pulps used for the recording sheet of the present invention, mention may be made of, for example, NBKP, LBKP, NBSP, LBSP, GP, TMP and recycled pulps. They are used in admixture of several kinds at a ratio depending on the purpose. Furthermore, they can contain loading materials such as kaolin, talc, calcium carbonate and titanium oxide, dyes, sizing agents, fixing agents, wet strengthening agents, dry strengthening agents, etc. which are normally used in paper making.

When a coating liquid containing the polyvinylamine copolymer and the ultrafine inorganic pigment is coated on the surface of a base paper by various blade, rod, air knife and curtain coaters such as size press, gate roll coater, bill blade coater, blade metering size press, bell bar coater and short dowel coater, the coating liquid may contain general surface sizing agents such as polymers of styrene-acrylic acid, olefin-maleic acid, acrylic acid and styrene-maleic acid, dyes, fluorescent brighteners, dye fixers, surface strengthening agents, etc.

The ink jet recording sheet of the present invention exhibits effective characteristics. The mechanism thereof is not entirely clear, but it is considered that the characteristics are exhibited by the following actions.

The water-soluble ink used in the present invention contains at least one of water-soluble acid dyes and water-soluble direct dyes as a dye and in addition, a wetting agent, a dye dissolving agent, a preservative, an antifungul agent, etc.

The water-soluble direct dyes include, for example, O.I Direct Black, O.I Direct Yellow, O.I Direct Blue, and O.I Direct Red and the water-soluble acid dyes include, for example, C.I Acid Black, C.I Acid Yellow, C.I Acid Blue, and C.I Acid Red. These are not limitative. These dyes obtain the water-solubility through sulfonic acid, sodium sulfonate and ammonium group in the dye molecule, and when such ink is applied and adsorbed to a recording medium, the anion group in the ink bonds to the cation of the polyvinylamine copolymer in the recording sheet to form an insoluble salt and as a result, water resistance of images is improved and light resistance is also improved.

Furthermore, it is said that the polyvinylamine copolymer which is a primary amine and which is obtained by copolymerization with acrylonitrile shows substantially no cationic properties in an atmosphere called neutral, but because of its polymer structure, it does not lose cationic properties and even a support having an extraction pH of 6.5–9 which is prepared in a neutral or weakly alkaline atmosphere can provide water resistance of water-soluble dyes and does not cause reduction in light resistance of the dyes.

The present invention will be explained in more detail by the following nonlimiting examples. In the examples, "part" and "%" are all by weight. The value which shows coating amount is the weight after dried, unless otherwise notified.

PREPARATION EXAMPLE 1

A polyvinylamine copolymer was prepared as shown below in accordance with the method disclosed in Japanese Patent Kokai (Laid-Open) No.4-11094.

In a reactor equipped with a stirrer, a nitrogen introducing pipe and a condenser tube were charged 4 g of starting material composed of N-vinylformamide and acrylonitrile at a molar ratio of 45/55 and 35.9 g of desalted water. The content was heated to 60° C. with stirring in a nitrogen gas stream and then, thereto was added 0.12 g of a 10 wt % aqueous solution of 2,2'-azobis-2-amidinopropane-dihydrochloride, followed by stirring at 60° C. for 3 hours to obtain a polymer. Reaction rate of the monomers in this case was about 93%. Furthermore, concentrated hydrochloric acid in an amount equivalent to the formyl group in the polymer was added to the polymer, followed by stirring at 75° C. for 8 hours to hydrolyze the polymer. The resulting polymer solution was added to acetone and the precipitated polymer was vacuum dried and dissolved in desalted water. The polymer had a weight-average molecular weight of about 80,000. The molar ratio of vinylamine was measured by the method of quantitative determination of primary amine with copper-(ethylenedinitro)tetra-acetic acid described in "Bunseki Kagaku Binran (Handbook of Analytical Chemistry)" to obtain about 40 mol %.

PREPARATION EXAMPLE 2

A polymer was obtained in the same manner as in Preparation Example 1 except that the molar ratio of N-vinylformamide and acrylonitrile was 24/78. The weight-average molecular weight of the polymer was about 80,000 and the molar ratio of vinylamine was 20 mol %.

PREPARATION EXAMPLE 3

A polymer was obtained in the same manner as in Preparation Example 1 except that the molar ratio of N-vinylformamide and acrylonitrile was 24/78 and the polymerization time was 1 hour. The weight-average molecular weight of the polymer was about 30,000 and the molar ratio of vinylamine was 20 mol %.

PREPARATION EXAMPLE 4

A polymer was obtained in the same manner as in Preparation Example 1 except that the molar ratio of N-vinylformamide and acrylonitrile was 12/88. The weight-average molecular weight was about 70,000 and the molar ratio of vinylamine was about 10 mol %.

EXAMPLE 1

To a mixture of LBKP beaten to a freeness of 380 ml C.S.F. by PFI mill and NBKP beaten to a freeness of 450 ml C.S.F. by PFI mill at a weight ratio of 7:3 were added, based on solid content of pulp, 10% by weight (solid content) of precipitated calcium carbonate (Trade name: TP121 manufactured by Okutama Kogyo Co., Ltd.), 0.6% by weight (solid content) of aluminum sulfate, 0.1% by weight (solid content) of alkyl ketene dimer (Trade name: SIZE PINE K903 manufactured by Arakawa Kagaku Co., Ltd.), and 0.8% by weight (solid content) of an amphoteric starch (Trade name: CATO 3210 manufactured by National Starch & Chemical Company). A base paper of 80 g/m$^2$ in basis weight was made from the resulting mixture.

Thereafter, on the base paper was coated a coating liquid for ink-receiving layer which had a solid concentration of 30% and which was composed of 100 parts of a cationic colloidal silica (Trade name: SNOW TEX-AK (3) manufactured by Nissan Chemical Co., Ltd., primary particle size: 10–20 nm) as an ultrafine inorganic pigment, 10 parts of a water-soluble polymer (Trade name: PVA 117 manufactured by Kuraray Co., Ltd.) as an adhesive and 30 parts of the polyvinylamine copolymer prepared in Preparation Example 1 as a dye fixer by a roll coater at a coating amount of 0.3 g/m$^2$ in terms of dry solid content, followed by drying the coat. The coated base paper was supercalendered so as to give a Beck smoothness of 80 seconds, thereby to obtain an ink jet recording sheet.

EXAMPLE 2

An ink jet recording sheet was prepared in the same manner as in Example 1 except that the coating amount of the coating liquid for ink-receiving layer was 0.5 g/m$^2$.

EXAMPLE 3

An ink jet recording sheet was prepared in the same manner as in Example 1 except that the coating amount of the coating liquid for ink-receiving layer was 2 g/m$^2$.

EXAMPLE 4

An ink jet recording sheet was prepared in the same manner as in Example 1 except that the coating amount of the coating liquid for ink-receiving layer was 5 g/m$^2$.

EXAMPLE 5

An ink jet recording sheet was prepared in the same manner as in Example 1 except that the coating was carried out by hand using a No.10 rod and the coating amount of the coating liquid for ink-receiving layer was 10 g/m$^2$.

EXAMPLE 6

An ink jet recording sheet was prepared in the same manner as in Example 1 except that the amount of the polyvinylamine copolymer was 10 parts (8.3% by weight) and the coating amount of the coating liquid for ink-receiving layer was 2 g/m$^2$.

EXAMPLE 7

An ink jet recording sheet was prepared in the same manner as in Example 1 except that the amount of the polyvinylamine copolymer was 27.5 parts (20% by weight) and the coating amount of the coating liquid for ink-receiving layer was 2 g/m$^2$.

EXAMPLE 8

An ink jet recording sheet was prepared in the same manner as in Example 1 except that the amount of the polyvinylamine copolymer was 60 parts (35% by weight) and the coating amount of the coating liquid for ink-receiving layer was 2 g/m$^2$.

EXAMPLE 9

An ink jet recording sheet was prepared in the same manner as in Example 1 except that the polyvinylamine copolymer prepared in Preparation Example 2 was used and the coating amount of the coating liquid for ink-receiving layer was 2 g/m$^2$.

EXAMPLE 10

An ink jet recording sheet was prepared in the same manner as in Example 1 except that a colloidal silica having an average primary particle size of 65 nm (Trade name: SNOW TEX YL having an average particle size of 50–80 nm manufactured by Nissan Chemical Co., Ltd.) was used as the ultrafine inorganic pigment and the coating amount of the coating liquid for ink-receiving layer was 2 g/m$^2$.

EXAMPLE 11

An ink jet recording sheet was prepared in the same manner as in Example 1 except that an alumina hydrate (Trade name: CATALOID AS-3 having a primary particle size of about 10 nm manufactured by Shokubai Kasei Kogyo Co., Ltd.) was used as the ultrafine inorganic pigment and the coating amount of the coating liquid for ink-receiving layer was 2 g/m$^2$.

EXAMPLE 12

An ink jet recording sheet was prepared in the same manner as in Example 1 except that a colloidal silica having an average primary particle size of 300 nm (Trade name: SNOW TEX PST-3 having a primary particle size of 300±30 nm manufactured by Nissan Chemical Co., Ltd.) was used as the ultrafine inorganic pigment and the coating amount of the coating liquid for ink-receiving layer was 2 g/m$^2$.

EXAMPLE 13

An ink jet recording sheet was prepared in the same manner as in Example 1 except that a silica having an average particle size of 1.0 μm (Trade name: NIPSIL E220A having an average particle size of 1.0 μm manufactured by Nippon Silica Co., Ltd.) was used as the ultrafine inorganic pigment and the coating amount of the coating liquid for ink-receiving layer was 2 g/m$^2$.

EXAMPLE 14

An ink jet recording sheet was prepared in the same manner as in Example 1 except that a base paper having an extraction pH of 6.5 and made using kaolin (Trade name: BELITUNG KAOLIN manufactured by ALTER ABADI Co., Ltd.) in place of the precipitated calcium carbonate was used and the coating amount of the coating liquid for ink-receiving layer was 2 g/m$^2$.

EXAMPLE 15

An ink jet recording sheet was prepared in the same manner as in Example 1 except that a base paper having an extraction pH of 4.5 and made using kaolin (Trade name: BELITUNG KAOLIN manufactured by ALTER ABADI Co., Ltd.) in place of the precipitated calcium carbonate and 0.3% of a rosin sizing agent in place of the alkyl ketene dimer with changing the amount of aluminum sulfate to 2% was used and the coating amount of the coating liquid for ink-receiving layer was 2 g/m$^2$.

EXAMPLE 16

An ink jet recording sheet was prepared in the same manner as in Example 1 except that 3% by weight of the polyvinylamine copolymer was contained in the base paper and the ink-receiving layer was not provided.

EXAMPLE 17

An ink jet recording sheet was prepared in the same manner as in Example 1 except that 3% by weight of the polyvinylamine copolymer used in Example 1 was contained in the base paper having an extraction pH of 4.5 made in Example 10 and the ink-receiving layer was not provided.

EXAMPLE 18

An ink jet recording sheet was prepared in the same manner as in Example 1 except that 1% by weight of the polyvinylamine copolymer was contained in the base paper and the ink-receiving layer was not provided.

EXAMPLE 19

An ink jet recording sheet was prepared in the same manner as in Example 1 except that 0.5% by weight of the polyvinylamine copolymer was contained in the base paper and the ink-receiving layer was not provided.

EXAMPLE 20

An ink jet recording sheet was prepared in the same manner as in Example 1 except that 0.5 g/m$^2$ of the polyvinylamine copolymer was coated by size press treatment and the ink-receiving layer was not provided.

EXAMPLE 21

An ink jet recording sheet was prepared in the same manner as in Example 1 except that 0.1 g/m$^2$ of the polyvinylamine copolymer was coated by size press treatment and the ink-receiving layer was not provided.

EXAMPLE 22

An ink jet recording sheet was prepared in the same manner as in Example 1 except that 0.05 g/m$^2$ of the polyvinylamine copolymer was coated by size press treatment and the ink-receiving layer was not provided.

COMPARATIVE EXAMPLE 1

An ink jet recording sheet was prepared in the same manner as in Example 1 except that the polyvinylamine copolymer prepared in Preparation Example 3 was used and the coating amount of the coating liquid for ink-receiving layer was 2 g/m$^2$.

COMPARATIVE EXAMPLE 2

An ink jet recording sheet was prepared in the same manner as in Example 1 except that the polyvinylamine copolymer prepared in Preparation Example 4 was used and the coating amount of the coating liquid for ink-receiving layer was 2 g/m$^2$.

COMPARATIVE EXAMPLE 3

An ink jet recording sheet was prepared in the same manner as in Example 1 except that 3% by weight of the polyvinylamine copolymer prepared in Preparation Example 3 was contained in the base paper and the ink-receiving layer was not provided.

COMPARATIVE EXAMPLE 4

An ink jet recording sheet was prepared in the same manner as in Example 1 except that dicyanamide (Trade name: NIKAFOC D100 manufactured by Japan Carbide Co., Ltd.) was used as the polyvinylamine copolymer.

COMPARATIVE EXAMPLE 5

An ink jet recording sheet was prepared in the same manner as in Example 1 except that a quaternary amine salt (Trade name: ACCURAC 41 manufactured by Mitsui Cyanamide Co., Ltd.) was used as the polyvinylamine copolymer.

COMPARATIVE EXAMPLE 6

An ink jet recording sheet was prepared in the same manner as in Example 1 except that a secondary amine salt (Trade name: SUMIREZ RESIN 1001 manufactured by Sumitomo Chemical Co., Ltd.) was used as the polyvinylamine copolymer.

COMPARATIVE EXAMPLE 7

An ink jet recording sheet was prepared in the same manner as in Example 1 except that the base paper was not coated with the ink-receiving layer.

Results of evaluation are shown in Table 1. The items of evaluation and methods of evaluation are as follows.

(1) Shape factor of dot

For evaluation of spread of the ink dot, monochromatic dot was printed with a black ink using an ink jet printer (IO-720 manufactured by Sharp Corporation), and length of perimeter of the dot and area of the dot were measured by an image analyzer (RUZEX 5000 manufactured by Nireco Co.) and shape factor SF 2 was calculated therefrom. The shape factor SF 2 is an index which approaches to 100 with the dot approaching to a true circle and 250 or less is practically acceptable.

(2) Optical density

The optical density of the solid portion printed with each of black (Bk), cyan (C), magenta (M) and yellow (Y) inks was measured by a reflective densitometer (Macbeth RD918 manufactured by Macbeth Co., Ltd.). The higher value indicates the higher and better optical density. Normally, 1.00 or more is practically acceptable.

(3) Water resistance

A recording sheet on which a solid image was printed with a magenta ink was dipped in running water for 10 minutes and a retention rate (retention rate=optical density of the image after dipping/optical density of the original image) was measured. When the retention rate is 90% or higher, the water resistance is good, but even the retention rate of 85% is practically acceptable level.

(4) Light resistance

A recording sheet on which a solid image was printed with a magenta ink was irradiated for 24 hours by a xenon fadeometer (Trade name: WEATHER-OMETER Ci35 manufactured by Atlas Co. Ltd.) and the retention rate of the image was measured. When the retention rate of optical density is 60% or higher, the light resistance is good, but even the rate of 50% is practically acceptable level.

TABLE 1

| | Content of vinylamine residue | Amount of copolymer | Coating amount | Particle size | Shape factor | Optical density | | | | Water resistance | Light resistance |
|---|---|---|---|---|---|---|---|---|---|---|---|
| | (mol %) | (part) | (g/m$^2$) | (nm) | SF2 | Bk | C | M | Y | (%) | (%) |
| Example 1 | 40 | 30 | 0.3 | 15 | 230 | 1.13 | 1.10 | 1.15 | 1.14 | 87 | 63 |
| Example 2 | 40 | 30 | 0.5 | 15 | 210 | 1.15 | 1.12 | 1.16 | 1.17 | 93 | 63 |
| Example 3 | 40 | 30 | 2.0 | 15 | 195 | 1.17 | 1.15 | 1.18 | 1.18 | 97 | 62 |
| Example 4 | 40 | 30 | 5.0 | 15 | 190 | 1.20 | 1.18 | 1.21 | 1.22 | 98 | 61 |
| Example 5 | 40 | 30 | 10.0 | 15 | 180 | 1.25 | 1.22 | 1.24 | 1.25 | 97 | 60 |
| Example 6 | 40 | 10 | 2.0 | 15 | 200 | 1.16 | 1.15 | 1.18 | 1.18 | 92 | 63 |
| Example 7 | 40 | 28 | 2.0 | 15 | 195 | 1.17 | 1.15 | 1.18 | 1.17 | 97 | 62 |
| Example 8 | 40 | 60 | 2.0 | 15 | 196 | 1.17 | 1.15 | 1.17 | 1.18 | 98 | 59 |
| Example 9 | 20 | 30 | 2.0 | 15 | 195 | 1.17 | 1.15 | 1.18 | 1.18 | 90 | 62 |
| Example 10 | 40 | 30 | 2.0 | 65 | 200 | 1.17 | 1.15 | 1.18 | 1.18 | 96 | 63 |
| Example 11 | 40 | 30 | 2.0 | 10 | 198 | 1.18 | 1.16 | 1.18 | 1.19 | 97 | 62 |
| Example 12 | 40 | 30 | 2.0 | 30 | 195 | 1.17 | 1.16 | 1.18 | 1.17 | 97 | 62 |
| Example 13 | 40 | 30 | 2.0 | 1000 | 210 | 1.08 | 1.05 | 1.06 | 1.07 | 97 | 62 |
| Example 14 | 40 | 30 | 2.0 | 15 | 198 | 1.17 | 1.15 | 1.17 | 1.18 | 97 | 61 |
| Example 15 | 40 | 30 | 2.0 | 15 | 194 | 1.18 | 1.16 | 1.18 | 1.19 | 97 | 63 |
| Example 16 | 40 | — | — | — | 240 | 1.03 | 1.01 | 1.02 | 1.02 | 93 | 68 |
| Example 17 | 40 | — | — | — | 245 | 1.03 | 1.01 | 1.03 | 1.03 | 92 | 64 |

TABLE 1-continued

| | Content of vinylamine residue | Amount of copolymer | Coating amount | Particle size | Shape factor | Optical density | | | | Water resistance | Light resistance |
|---|---|---|---|---|---|---|---|---|---|---|---|
| | (mol %) | (part) | (g/m²) | (nm) | SF2 | Bk | C | M | Y | (%) | (%) |
| Example 18 | 40 | — | — | — | 242 | 1.02 | 1.01 | 1.04 | 1.03 | 91 | 64 |
| Example 19 | 40 | — | — | — | 243 | 1.04 | 1.01 | 1.02 | 1.03 | 87 | 66 |
| Example 20 | 40 | — | — | — | 244 | 1.03 | 1.01 | 1.02 | 1.03 | 95 | 65 |
| Example 21 | 40 | — | — | — | 242 | 1.04 | 1.01 | 1.04 | 1.03 | 92 | 66 |
| Example 22 | 40 | — | — | — | 245 | 1.02 | 1.01 | 1.03 | 1.02 | 88 | 66 |
| Comparative Example 1 | 20 | 30 | 2.0 | 15 | 196 | 1.17 | 1.15 | 1.18 | 1.18 | 82 | 62 |
| Comparative Example 2 | 10 | 30 | 2.0 | 15 | 200 | 1.17 | 1.15 | 1.18 | 1.18 | 76 | 60 |
| Comparative Example 3 | 20 | — | — | — | 240 | 1.02 | 1.01 | 1.03 | 1.03 | 72 | 65 |
| Comparative Example 4 | — | 30 | 0.3 | 15 | 210 | 1.10 | 1.09 | 1.12 | 1.11 | 99 | 20 |
| Comparative Example 5 | — | 30 | 0.3 | 15 | 215 | 1.17 | 1.16 | 1.18 | 1.19 | 87 | 31 |
| Comparative Example 6 | — | 30 | 0.3 | 15 | 220 | 1.18 | 1.16 | 1.19 | 1.19 | 86 | 42 |
| Comparative Example 7 | — | — | — | — | 320 | 0.85 | 0.83 | 0.88 | 0.89 | 40 | 72 |

As can be seen from the results of Examples 1–17 shown in Table 1, when the polyvinylamine copolymer of the present invention obtained by copolymerization of N-vinylformamide and acrylonitrile is coated on the base paper or contained in the base paper, retention rate of the density can be improved to higher than 85% even when a magenta ink which is lowest in water resistance is used. Furthermore, as shown in Examples 1–5, when ultrafine inorganic pigment is used in combination and when coating amount is increased, shape of the dot (resolution) can be improved and even if the coating amount is more than 5 g/m², no larger merit can be obtained.

As shown in Comparative Examples 1–3, when molecular weight of the polyvinylamine is less than 50000 or when the molar ratio of vinylamine is less than 20 mol %, the water resisting effect can hardly be expected. It is further seen that use of dicyandiamine and quaternary cation causes considerable deterioration of light resistance. Furthermore, as shown in Examples 13–17, the polyvinylamine copolymer of the present invention shows good water resistance for both the papers acidic in extraction pH and papers neutral or alkaline in extraction pH. In addition, as shown in Examples 17–22, excellent water resistance can be obtained by containing the polymer in the recording sheet by adding the polymer to the pulp or by size press treatment.

The ink jet recording sheet of the present invention can be provided with superior water resistance by using as a dye fixer a polyvinylamine copolymer obtained by copolymerization of N-vinylformamide and acrylonitrile. In addition, by coating an ink-receiving layer mainly composed of ultrafine inorganic pigment having a specific particle size, the ink jet recording sheet is further improved in water resistance, image density and print quality.

What is claimed is:

1. An ink jet recording sheet which contains in a paper support and/or in a layer coated on the support a polyvinylamine copolymer obtained from a copolymer of N-vinylformamide and acrylonitrile, said copolymer having a weight-average molecular weight of 50000 or more and containing 20 mol % or more of a vinylamine residue, wherein the polyvinylamine copolymer is contained in an amount of 1% by weight or more based on the solid content of pulp in the support or coated on the surface of the support in an amount of 0.1 g/m² or more.

2. An ink jet recording sheet according to claim 1, wherein the support has an extraction pH of 6–9.

3. An ink jet recording sheet comprising a support and an ink-receiving layer provided on the support wherein a composition of the ink-receiving layer contains ultrafine inorganic pigment having a primary particle size of 100 nm or smaller and a polyvinylamine copolymer obtained from a copolymer of N-vinylformamide and acrylonitrile as a dye fixer, said copolymer having a weight-average molecular weight of 50000 or more and containing 20 mol % or more of a vinylamine residue, wherein the polyvinylamine copolymer is coated on the surface of the support in an amount of 0.1 g/m² or more.

4. An ink jet recording sheet according to claim 3 wherein coating amount of the ink-receiving layer is 0.5 g/m² or more and 20% by weight or more of the polyvinylamine copolymer is contained in the composition of the ink-receiving layer.

5. An ink jet recording sheet according to claim 3, wherein the support has an extraction pH of 6–9.

* * * * *